US009217234B2

(12) United States Patent
Pusheck et al.

(10) Patent No.: US 9,217,234 B2
(45) Date of Patent: Dec. 22, 2015

(54) REEL WITH STEPPED CONFIGURATION

(71) Applicant: Harnischfeger Technologies, Inc., Wilmington, DE (US)

(72) Inventors: Bernard Pusheck, Cudahy, WI (US); Jason Knuth, Brookfield, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 103 days.

(21) Appl. No.: 14/201,167

(22) Filed: Mar. 7, 2014

(65) Prior Publication Data

US 2014/0271075 A1 Sep. 18, 2014

Related U.S. Application Data

(60) Provisional application No. 61/779,221, filed on Mar. 13, 2013, provisional application No. 61/791,380, filed on Mar. 15, 2013.

(51) Int. Cl.

| | |
|---|---|
| ***B65H 75/34*** | (2006.01) |
| ***E02F 3/30*** | (2006.01) |
| ***E21B 19/22*** | (2006.01) |
| ***E02F 9/22*** | (2006.01) |
| ***B65H 75/42*** | (2006.01) |
| ***B65H 75/44*** | (2006.01) |

(52) U.S. Cl.

CPC ..... *E02F 3/308* (2013.01); *B65H 75/425* (2013.01); *B65H 75/4415* (2013.01); *E02F 3/305* (2013.01); *E02F 9/2275* (2013.01); *E21B 19/22* (2013.01); *B65H 75/34* (2013.01)

(58) Field of Classification Search

CPC .. B65H 75/34; B65H 75/425; B65H 75/4415; E21B 19/22; E02F 9/2275; E02F 3/305; E02F 3/308

USPC ..... 137/355.16, 355.2, 355.26

See application file for complete search history.

(56) References Cited

U.S. PATENT DOCUMENTS

| | | | | |
|---|---|---|---|---|
| 3,958,775 | A * | 5/1976 | Liga | 242/118.8 |
| 4,022,047 | A | 5/1977 | Remner et al. | |
| 4,262,854 | A | 4/1981 | Jett | |
| 5,622,333 | A | 4/1997 | Jacques | |
| 5,641,132 | A | 6/1997 | Bardy | |
| 5,918,827 | A | 7/1999 | Pulliam | |
| 6,050,290 | A * | 4/2000 | Yacobi et al. | 137/355.2 |
| 6,416,013 | B1 | 7/2002 | Benzing, II | |
| 6,802,336 | B1 * | 10/2004 | Holmquist | 137/355.2 |
| 7,445,175 | B2 | 11/2008 | Leyden et al. | |
| 2012/0181365 | A1 | 7/2012 | Triller | |
| 2015/0003950 | A1 * | 1/2015 | Hren et al. | 414/722 |

FOREIGN PATENT DOCUMENTS

| | | |
|---|---|---|
| FR | 2800524 | 5/2001 |

* cited by examiner

*Primary Examiner* — Kevin Lee

(74) *Attorney, Agent, or Firm* — Michael Best & Friedrich LLP

(57) ABSTRACT

A reel system includes a reel having a rotational axis, the reel including a plurality of ledges spaced radially from the rotational axis, the ledges defining a stepped configuration along an interior surface of the reel. The reel system also includes a first clamp having a first width and a second clamp having a second width greater than the first width, wherein the first clamp and the second clamp engage the plurality of ledges as the reel is rotated.

20 Claims, 4 Drawing Sheets

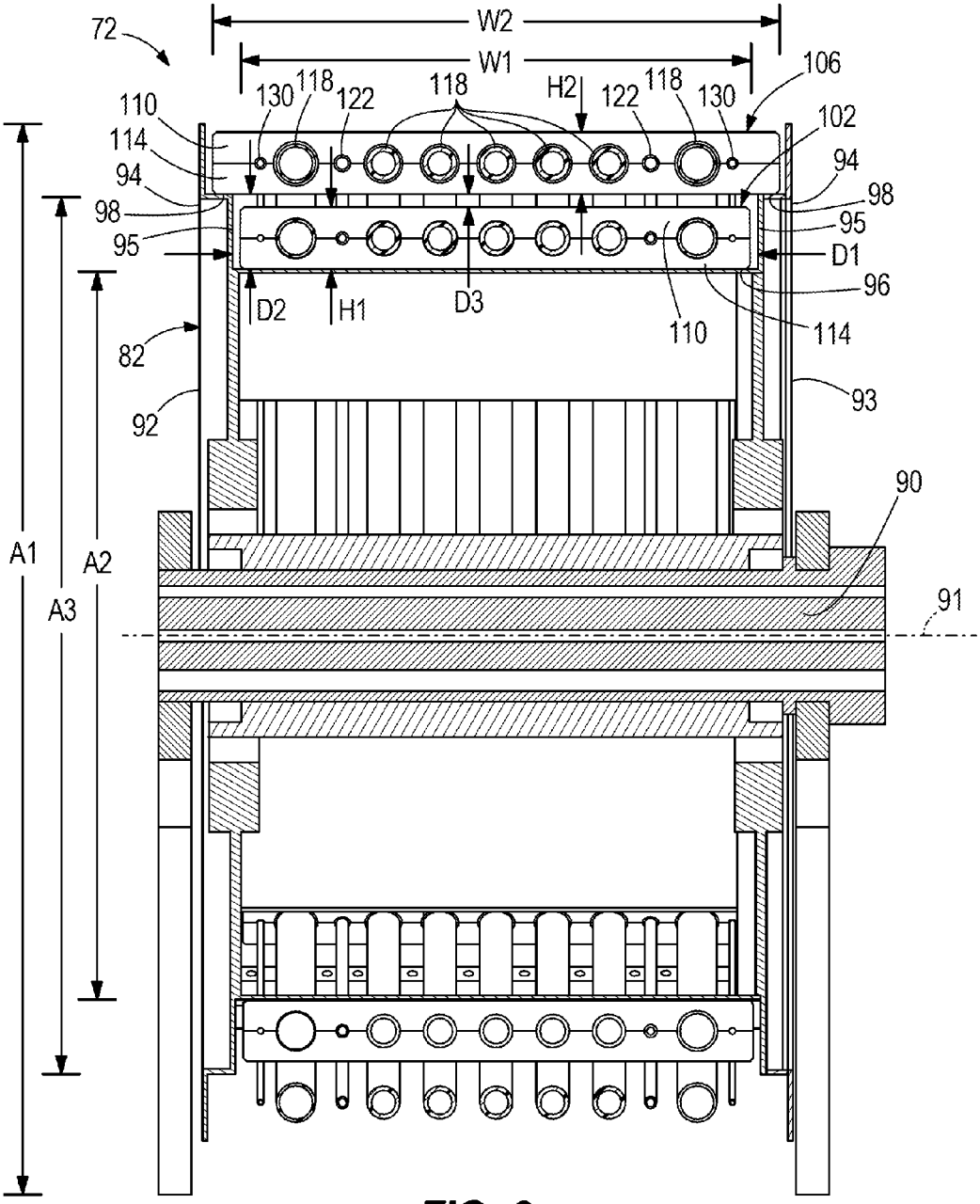
FIG. 3
FIG. 4
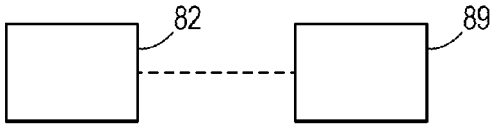

REEL WITH STEPPED CONFIGURATION

CROSS-REFERENCE TO RELATED APPLICATIONS

This application claims priority to U.S. Provisional Application No. 61/779,221, filed Mar. 13, 2013, and U.S. Provisional Application No. 61/791,380, filed Mar. 15, 2013, the entire contents of each of which are incorporated herein by reference.

FIELD OF THE INVENTION

The present invention relates to the field of mining shovels. Specifically, the present invention relates to a fluid conveyance system for a shovel bucket.

BACKGROUND OF THE INVENTION

Industrial mining machines, such as electric rope or power shovels, draglines, etc., are used to execute digging operations to remove material from a bank of a mine. On a conventional rope shovel, a dipper is attached to a handle, and the dipper is supported by a cable, or rope, that passes over a boom sheave. The rope is secured to a bail that is pivotably coupled to the dipper. During a hoist phase, the rope is reeled in by a winch, lifting the dipper upward through the bank and liberating the material to be dug. The handle is moved along a rack and pinion relative to the boom as desired to maneuver a position of the dipper. Hydraulic lines are used to deliver power to various mechanical components and linkages on the industrial machine, including the dipper.

SUMMARY

In accordance with one construction, a reel system includes a reel having a rotational axis, the reel including a plurality of ledges spaced radially from the rotational axis, the ledges defining a stepped configuration along an interior surface of the reel. The reel system also includes a first clamp having a first width and a second clamp having a second width greater than the first width, wherein the first clamp and the second clamp engage the plurality of ledges as the reel is rotated.

In accordance with another construction, a reel system includes a reel having a rotational axis, the reel including a shaft, a first member positioned at a first end of the shaft and a second member positioned at a second end of the shaft, the first and second members defining a first interior width. The reel further includes a first circumferential ledge defining a second interior width less than the first interior width, and a second circumferential ledge defining a third interior width less than the first interior width and greater than the second interior width.

In accordance with another construction, a mining machine includes a handle, a plurality of conduits coupled to the handle, and a reel system. The reel system includes a reel having an axis of rotation, and a plurality of ledges spaced radially from the rotational axis, the ledges defining a stepped configuration along an interior surface of the reel. The reel system also includes a plurality of first clamps having a first width, and a plurality of second clamps having a second width greater than the first width, wherein the first and second clamps are coupled to the conduits and engage the plurality of ledges as the reel is rotated Other aspects of the invention will become apparent by consideration of the detailed description and accompanying drawings.

BRIEF DESCRIPTION OF THE DRAWINGS

FIG. 3 is a cross-sectional view of the reel system of FIGS. 2 and 2A, taken along line 3-3 in FIG. 2A.

FIG. 4 is a schematic illustration of a reel of the reel system of FIGS. 2 and 2A, and an independent motor.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
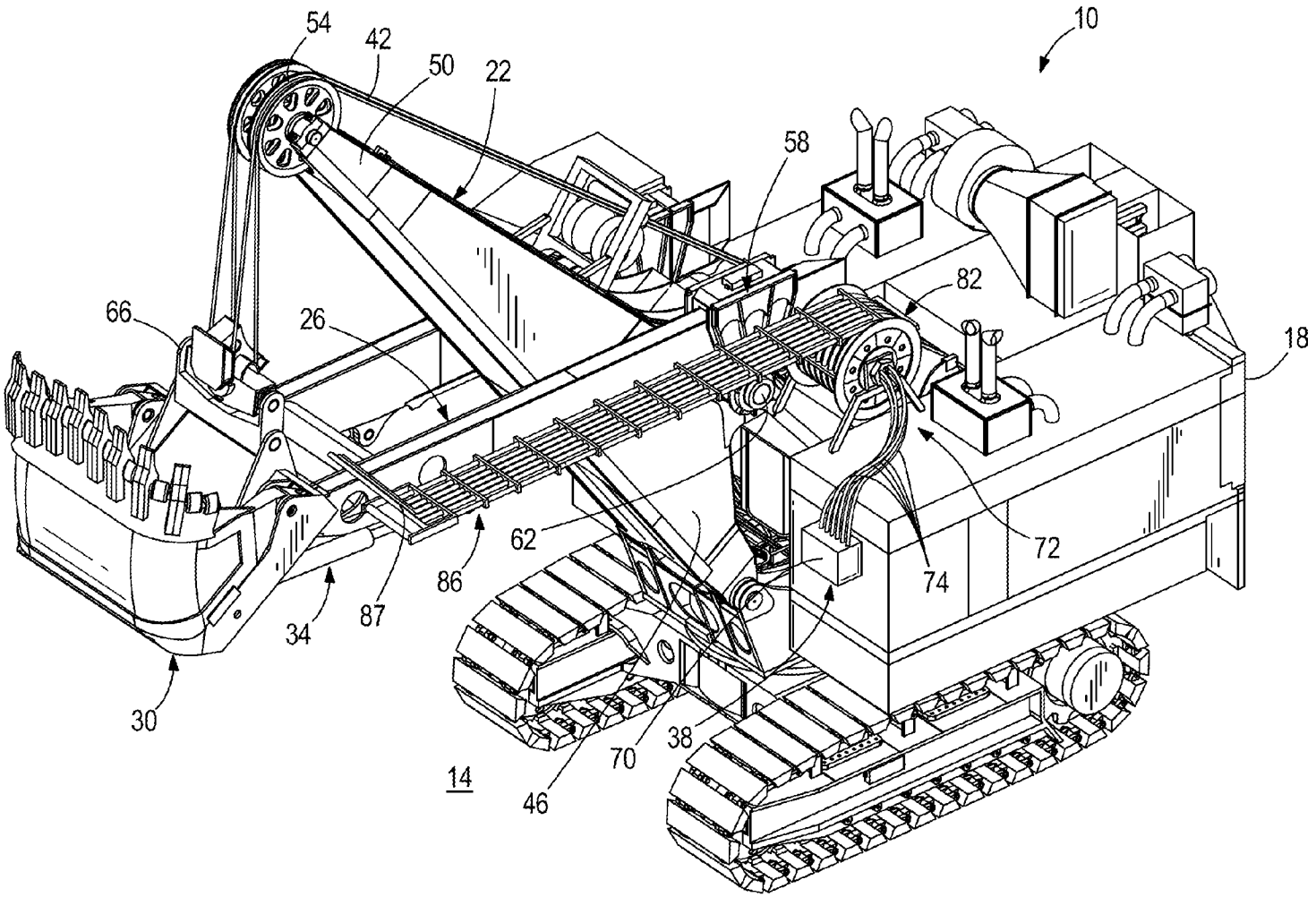
FIG. 1 is a perspective view of a mining shovel.

FIG. 1 illustrates a mining shovel 10. The mining shovel 10 rests on a support surface or floor 14 and includes a base 18, a boom 22, a handle 26, a dipper 30, tilt actuators 34, and a hydraulic system 38. The base 18 includes a hoist drum (not shown) for reeling in and paying out a cable or rope 42. The boom 22 includes a first end 46 coupled to the base 18, a second end 50 opposite the first end 46, a boom sheave 54 coupled to the second end 50, a saddle block 58, and a shipper shaft 62. The boom sheave 54 guides the cable or rope 42 over the second end 50. The saddle block 58 is rotatably coupled to the boom 22 by the shipper shaft 62, which is positioned between the first end 46 and the second end 50 of the boom 22 and extends through the boom 22. The cable or rope 42 is coupled to the dipper 30 by a bail 66, and the dipper 30 is raised or lowered as the cable or rope 42 is reeled in or paid out, respectively, by the hoist drum.

Figure 2:
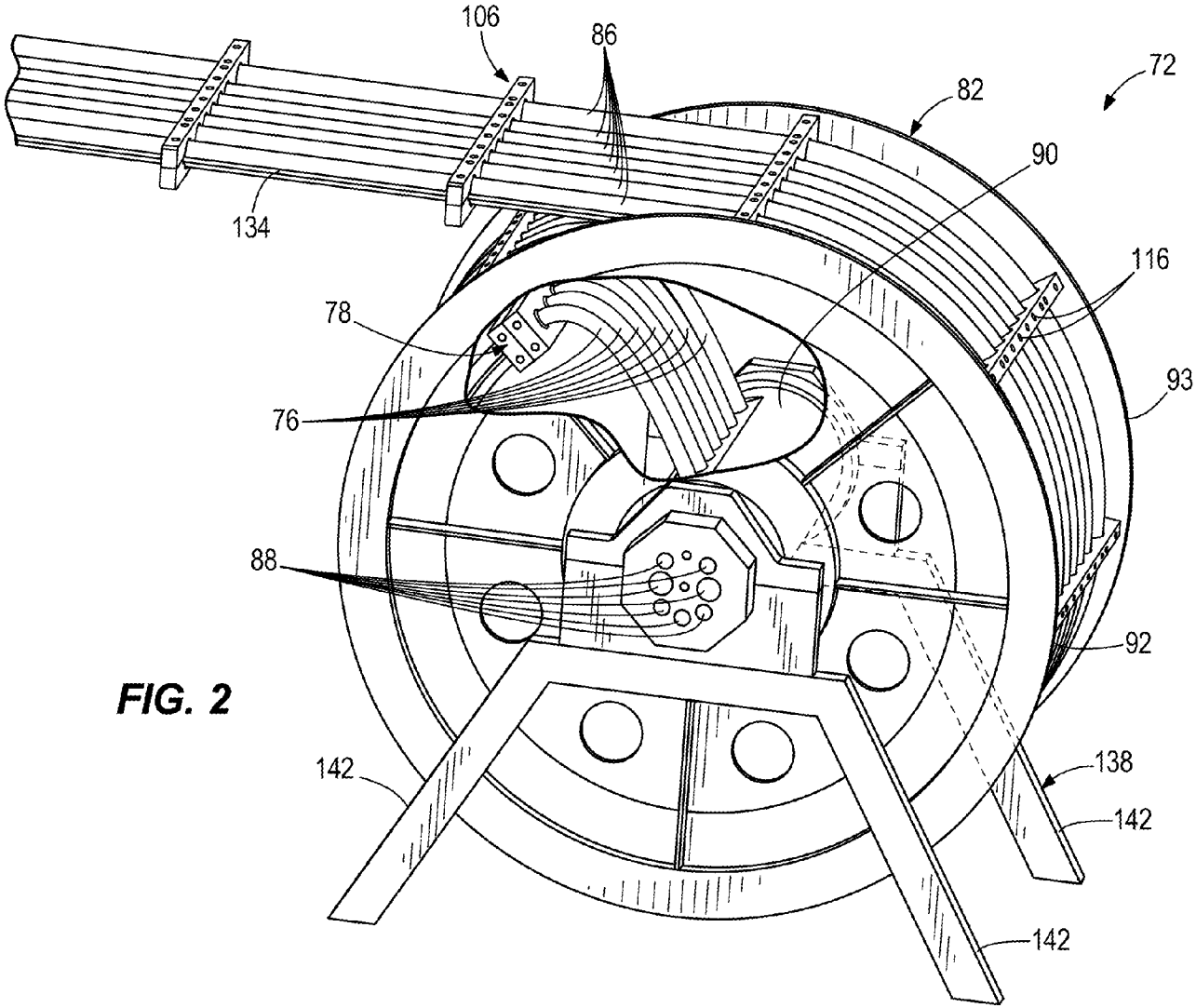
FIGS. 2 and 2A are perspective views of a reel system on the mining shovel of FIG. 1.

With reference to FIGS. 1-5, the hydraulic system 38 includes a fluid source 70 (illustrated schematically in FIG. 1) disposed in the base 18. The hydraulic system 38 also includes a reel system 72 coupled to the fluid source 70. The reel system 72 includes a first set of rigid conduits 74 (FIG. 1), a second set of rigid conduits 76 (FIG. 2), a valve block 78 (FIG. 2), a reel 82, a third set of flexible conduits 86, and a manifold 87 (FIG. 1). The first set of conduits 74 extends from the hydraulic source 70 to a set of input ports 88 (FIGS. 2 and 2A) on the reel 82, and the second set of conduits 76 extends from the input ports 88 to the valve block 78. The third set of conduits 86 extends from the valve block 78, along the handle 26, and to the manifold 87. The manifold 87 is rigidly coupled to the handle 26 near the tilt actuators 34. As illustrated in FIG. 2, the valve block 78 is disposed within the reel 82, and is a manifold that provides fluid communication between the first set of conduits 74, the second set of conduits 76, and the third set of conduits 86.

The conduits 74, 76, 86 provide pathways for movement of fluid (e.g. hydraulic fluid) from one area of the shovel 10 to another. In particular, the hydraulic system 38 supplies pressurized hydraulic fluid to the tilt actuators 34 through the reel system 72 (i.e., through the first, second, and third set of conduits 74, 76, 86, and the reel 82), and accommodates various extension conditions of the handle 26 relative to the saddle block 62. The flexible conduits 86 carry hydraulic fluid along the handle 26, and an independent system 89 (FIG. 4) coupled to the shovel 10 drives rotation of the reel 82 in order to take up or pay out the third set of conduits 86 as the handle 26 retracts or crowds. The independent system 89 is, for example, a constant tension/torque motor, controlled stepper motor, or a mechanical system that links crowd and/or hoist motions of the shovel 10 and drives rotation of the reel 82. Rotation of the reel 82, in conjunction with rotation of the shipper shaft 66, maintains a preset tension on the third set of flexible conduits 86, which controls catenary sag of the conduits 86. In this way, the hydraulic system 38 utilizes the independent system 89 to pay out and reel in a length of the conduits 86, and to maintain the preset tension.

Figure 2A:
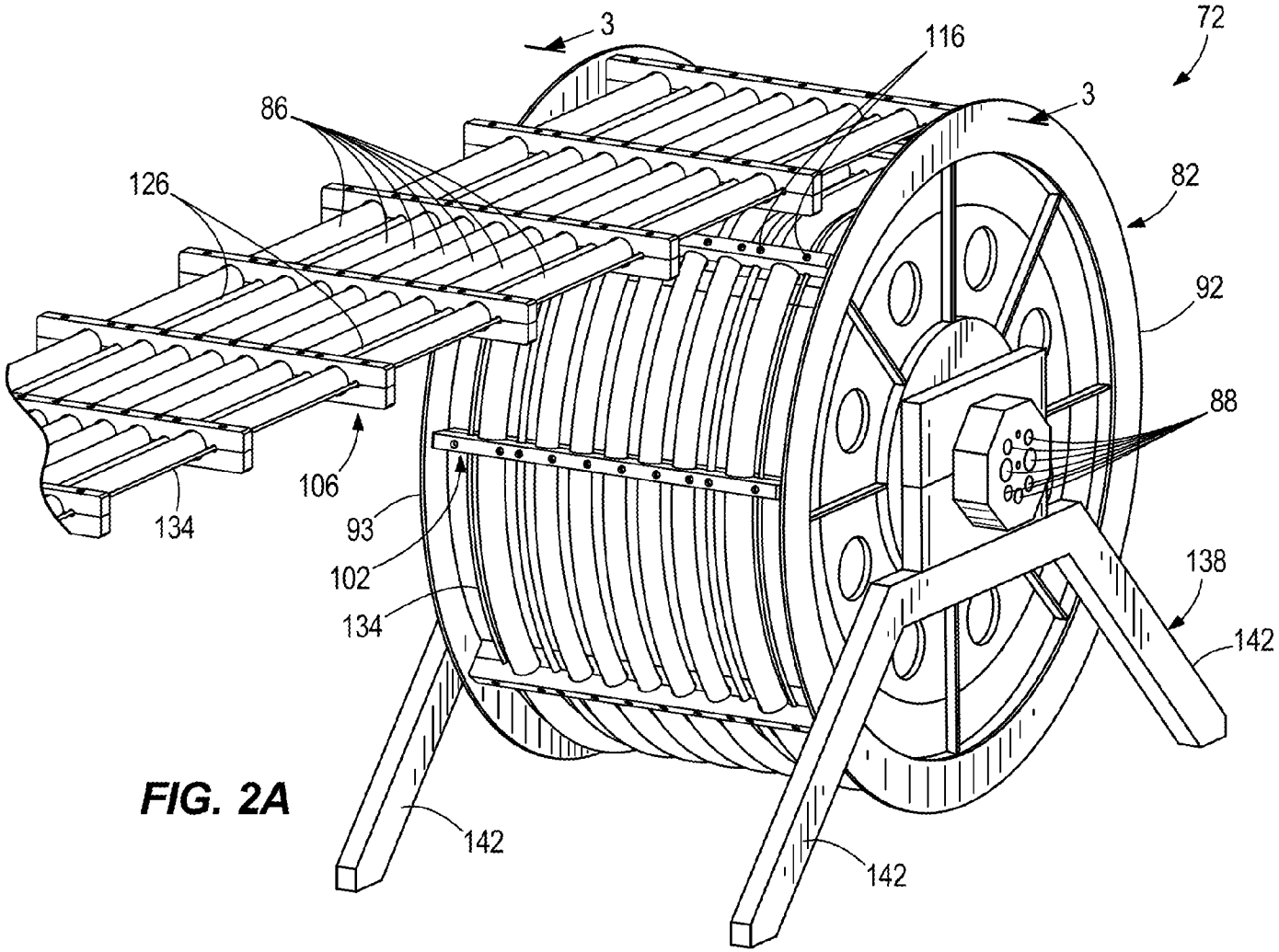

With continued reference to FIGS. 1, 2, and 2A, as the handle 26 is extended and the dipper 30 is moved away from the boom 22, the reel 82 is configured to reel out a length of the conduits 86. When the handle 26 is fully retracted, the reel 82 is configured to reel in the length of the conduits 86, and the conduits 86 are wrapped approximately one and a half times entirely around the circumference of the reel 82, thus providing multiple layers of conduits 86 extending around the circumference of the reel 82.

With reference to FIGS. 2, 2A, and 3, the reel 82 includes a central shaft 90 that defines an axis of rotation 91 that extends through the reel 82. The central shaft 90 is a swivel/rotary union centered in the reel 82 capable of transporting fluid through rotational motion, and includes the input ports 88.

With continued reference to FIGS. 2, 2A, and 3, the reel 82 also includes a first member 92 positioned at a first end of the shaft 90 and a second member 93 positioned at a second end of the shaft 90. Each of the members 92, 93 includes an exterior surface 94 and an interior surface 95 facing the interior surface 95 of the opposing member.

In the illustrated construction, and with reference to FIG. 3, the reel 82 has a stepped configuration along the interior surfaces 95 of the first and second members 92, 93 that includes a first interior ledge 96 formed on the first member 92. The first interior ledge 96 extends circumferentially about the axis of rotation 91. The reel 82 also includes a pair of second interior ledges 98, one formed on each of the reel members 92, 93. The second interior ledges 98 formed on the first and second members 92, 93 are positioned radially outward from the first interior ledge 96. The second interior ledges 98 extend circumferentially about the axis of rotation 91, and each has the same diameter such that the interior ledge 98 on the second member 93 is axially aligned with the interior ledge 98 on the first member 92. Each of the interior ledges 96, 98 defines a generally smooth support surface. In some constrictions, the first interior ledge 96 is formed on both members 92, 93. In some constructions, the second interior ledge 98 is formed on only one of the members 92, 93.

As illustrated in FIG. 3, the first member 92 and second member 93 define a first interior width A1, the ledge 96 defines a second interior width A2 less than the first interior width A1, and the ledges 98 define a third interior width A3 that is less than the first interior width A1 and greater than the second interior width A2.

With reference to FIG. 3, the second interior ledges 98 are spaced apart by an axial distance D1. In the illustrated construction, the distance D1 is equal to a width of the first interior ledge 96. In some constructions, the first interior ledge 96 is replaced by two, spaced-apart first interior ledges 96 (one formed on each member 92, 93), the first interior ledges 96 having an axial distance therebetween that is less than the axial distance between the second interior ledges 98. With continued reference to FIG. 3, the first interior ledge 96 is spaced apart from the two second interior ledges 98 by a radial distance D2.

With reference to FIGS. 2, 2A, and 3, the reel system 73 includes first clamps 102 and second clamps 106. The first clamps 102 and second clamps 106 receive and support the third set of conduits 86. Each of the first and second clamps 102, 106 includes a first body 110 and a second body 114. The bodies 110, 114 are removably coupled to one another, and are separate pieces, although in other constructions the first and second bodies 110, 114 are pivotably coupled to one another. As illustrated in FIGS. 2 and 2A, fasteners 116 are used to couple the first and second bodies 110, 114 together. In other constructions, various other configurations, shapes, and sizes of clamps are used. In some constructions the clamps 102, 106 are integrally formed with the conduits 86.

With reference to FIG. 3, the first clamps 102 each have a width W1 that is less than the axial distance D1 of the first interior ledge 96. The second clamps 106 each have a width, W2 which is greater than the width W1 of the first clamps 102 and is also greater than the axial distance D1 of the first interior ledge 96. When the conduits 86 are reeled in and supported by the reel 82, the first clamps 102 are supported by the first interior ledge 96, and the second clamps 106 are supported by the second interior ledges 98. Each of the first clamps 102 has a height H1, and each of the second clamps 106 has a height H2. The height H1 of the first clamps 102 is less than the radial distance D2 between the first interior ledge 96 and the second interior ledges 98. Therefore, when the conduits are reeled into the reel 82, the first clamps 102 are radially spaced from the second clamps 106 by a gap D3.

The first and second clamps 102, 106 each include a set of apertures 118 sized and shaped to receive the conduits 86 (e.g., hydraulic lines). In the illustrated construction, there are seven conduit apertures 118, although other constructions include fewer or more numbers of conduit apertures 118. The apertures 118 are formed by the first body 110 and the second body 114 being coupled together. The conduit apertures 118 have a diameter that is greater than diameters of the conduits 86 passing therethrough, so that there is some limited room for the conduits 86 to expand and contract within the clamps 102, 106 (e.g., due to fluid pressure changes in the conduits 86).

With reference to FIGS. 2A and 3, the first and second clamps 102, 106 also include apertures 122 sized and shaped to receive one or more of a grease line or electrical line 126. The apertures 122 are smaller in diameter than the apertures 118.

The first and second clamps 102, 106 also include a set of apertures 130. The apertures 130 are sized and shaped to receive cables 134 (FIGS. 2 and 2A). The apertures 130 are smaller in diameter than the apertures 118. The apertures 130 have a diameter that is sized small enough such that when the first and second bodies 110, 114 are coupled together, both the bodies 110, 114 press against the cables 134. The cables 134 absorb substantially all or any tension that develops during winding of the conduits 86. The conduits 86 absorb little or no tension as the conduits 86 are wound about the reel 82. Therefore, the conduits 86 are not stretched axially, and one conduit 86 is not loaded more than another conduit 86 as the conduits 86 are being wound.

With continued reference to FIGS. 2, 2A, and 3, the first clamps 102 are spaced along one portion of the conduits 86, and the second clamps 106 are spaced along another portion of the conduits 86. Thus, as the reel 82 is wound about the rotation axis 91, the first clamps 102 are taken up first, followed by the second clamps 106. As the first clamps 102 are taken up, the first clamps 102 sit on the first interior ledge 96. As the second clamps 106 are taken up, the second clamps 106 sit on the second interior ledges 98, spaced apart from the first clamps 102. In the illustrated construction, the number of second clamps 106 is greater than the number of first clamps 102. Both the first clamps 102 and the second clamps 106 are spaced apart evenly along the conduits 86. A distance between two first clamps 102 is equivalent to a distance between two second clamps 106. The second clamps 106 are spaced along the conduits 86, and are spaced from the manifold 87 in a manner that improves the reliability and life of the conduits 86, and in a manner that permits catenary sag as described above. In other constructions, different numbers and spacing for the clamps 102, 106 are used.

With reference to FIG. 2A, the reel 82 also includes a base structure 138. The base structure 138 includes a plurality of legs 142 and provides a support structure for the reel 82. The legs 142 are mounted on the base 18.

The reel system 72 is able to reel in the conduits 86 through more than one complete turn (e.g., through 1.5 turns, or 540 degrees) of the reel 82. The first complete turn reels in the first clamps 102, and the second turn (or portion of a turn) reels in the second clamps 106. The clamps 102, 106, in combination with the interior ledges 96, 98, keep the conduits 86 spaced apart from one another, and inhibit rubbing, wearing, and/or other contact that may damage the conduits 86. The conduits 86 are allowed to flex radially, but are inhibited from stretching axially due to the tension being taken up by the cables 134 in the clamps 102, 106. While other reels may only permit one complete turn during the winding (e.g., so as to prevent the conduits from contacting or rubbing one another during a second turn), the reel 82 allows for more than one complete turn as described above. Therefore, the reel 82 is relatively small in size compared to other reels that would take up the same length of conduits. In some constructions, the reel 82 further includes additional interior ledges, and additional clamps, thus allowing for an even further number of turns, and an even further smaller overall size of the reel. Overall, the reel 82 allows routing of hydraulic fluid from the base 18 to various components of the shovel 10, and in particular the tilt actuators 34, so that hydraulic fluid can be delivered during both translational and rotational motion of a rack and pinion joint and handle 26 in the machine 10, and so that the tilting dipper 30 can be used on the shovel 10.

While the reel 82 is described in the context of a mining shovel 10 and in the context of being driven by the independent system 89, in other constructions the reel 82 is used on machines other than a mining machine 10, and is driven by other structures other than independent system 89.

In some constructions the reel 82 is used to reel in conduits or cables including, but not limited to, hoses, wires, or other structures that benefit from use of the clamps 102, 106 described above and benefit from being wound in spaced-apart layers on the stepped reel 82.

Although the invention has been described in detail with reference to certain preferred embodiments, variations and modifications exist within the scope and spirit of one or more independent aspects of the invention as described.

The invention claimed is:

1. A reel system comprising:

a reel having a rotational axis, the reel including a plurality of ledges spaced radially away from the rotational axis, the ledges defining a stepped configuration along an interior surface of the reel;

a first clamp having a first width; and a second clamp having a second width greater than the first width, wherein the first and second clamps engage the plurality of ledges as the reel is rotated.

2. The reel system of claim 1, wherein the plurality of ledges includes a first ledge and a pair of second ledges, the second ledges spaced radially from the first ledge.

3. The reel system of claim 2, wherein the second ledges are spaced apart by an axial distance.

4. The reel system of claim 3, wherein the first width is less than the axial distance between the second ledges.

5. The reel system of claim 3, wherein the second width is greater than the axial distance between the second ledges.

6. The reel system of claim 1, wherein the plurality of ledges includes a first ledge and a second ledge spaced from the first ledge by a radial distance, and wherein the first clamp has a height that is less than the radial distance.

7. The reel system of claim 1, further comprising a plurality of first clamps and second clamps, and wherein a number of first clamps is less than a number of the second clamps.

8. The reel system of claim 1, wherein each of the first and second clamps includes a first body and a second body removably coupled to the first body.

9. The reel system of claim 1, wherein each of the first and second clamps includes a conduit aperture to receive a conduit.

10. The reel system of claim 1, wherein the reel includes a shaft defining the rotational axis, a first member positioned at a first end of the shaft and a second member positioned at a second end of the shaft, and wherein the plurality of ledges are disposed on the first and second members.

11. The reel system of claim 1, further comprising a plurality of hydraulic conduits that are wound up by the reel, and wherein the first and second clamps are both coupled to the hydraulic conduits.

12. The reel system of claim 11, wherein the first and second clamps include a plurality of conduit apertures that keep the hydraulic conduits spaced apart from one another.

13. The reel system of claim 1, wherein the reel includes a manifold and input ports, wherein the plurality of conduits are flexible conduits coupled to the manifold, and wherein the reel system further comprises a set of rigid conduits that extend from the manifold to the input ports.

14. The reel system of claim 13, further comprising a second set of rigid conduits that extend from the input ports to a fluid source.

15. A reel system comprising:

a reel having a rotational axis, the reel including a shaft, a first member positioned at a first end of the shaft and a second member positioned at a second end of the shaft, the first and second members defining a first interior width, the reel further including a first circumferential ledge defining a second interior width less than the first interior width, and a second circumferential ledge defining a third interior width less than the first interior width and greater than the second interior width.

16. The reel system of claim 15, further comprising a plurality of clamps that engage with the first and second ledges when the reel is rotated.

17. The reel system of claim 16, wherein the first ledge is spaced from the second ledge by a radial distance, and wherein one of the clamps has a height that is less than the radial distance.

18. A mining machine comprising:

a handle;

a plurality of conduits coupled to the handle; and a reel system coupled to the conduits, the reel system including a reel having a rotational axis and a plurality of ledges spaced radially from the rotational axis, the ledges defining a stepped configuration along an interior surface of the reel, the reel system also including a plurality of first clamps having a first width and a plurality of second clamps having a second width greater than the first width, wherein the first and second clamps are coupled to the conduits and engage the plurality of ledges as the reel is rotated.

19. The mining machine of claim 18, wherein the conduits are hydraulic conduits, and wherein each of the first and second clamps includes openings that receive the hydraulic conduits and separate the hydraulic conduits from one another.

20. The mining machine of claim 18, wherein the reel includes a manifold and input ports, wherein the plurality of conduits are flexible conduits coupled to the manifold, and wherein the mining machine further comprises a first set of rigid conduits that extend from a hydraulic source to the input ports, and a second set of rigid conduits that extend from the input ports to the manifold.

* * * * *